US009199286B2

(12) United States Patent
Jendrichowski et al.

(10) Patent No.: US 9,199,286 B2
(45) Date of Patent: Dec. 1, 2015

(54) CONTAINER CLEANING MACHINE WITH A CONTAINER OR BOTTLE CLEANING APPARATUS WITH A SPRAY PIPE AND SPRAY STATION WITH A SPRAY PIPE OF THIS TYPE

(75) Inventors: Klaus Jendrichowski, Holzwickede (DE); Ulrich Wiedemann, Dortmund (DE); Daniel Wald, Kamen (DE)

(73) Assignee: KHS GmbH, Dortmund (DE)

( * ) Notice: Subject to any disclaimer, the term of this patent is extended or adjusted under 35 U.S.C. 154(b) by 903 days.

(21) Appl. No.: 12/648,478

(22) Filed: Dec. 29, 2009

(65) Prior Publication Data

US 2011/0100505 A1 May 5, 2011

Related U.S. Application Data

(63) Continuation-in-part of application No. PCT/EP2008/004916, filed on Jun. 19, 2008.

(30) Foreign Application Priority Data

Jun. 29, 2007 (DE) ..... 10 2007 030 220

(51) Int. Cl.

| | |
|---|---|
| ***B65B 17/00*** | (2006.01) |
| ***B08B 9/34*** | (2006.01) |
| ***B08B 3/02*** | (2006.01) |
| *B05B 15/06* | (2006.01) |

(52) U.S. Cl.

CPC ... *B08B 9/34* (2013.01); *B08B 3/02* (2013.01); *B05B 15/069* (2013.01)

(58) Field of Classification Search

USPC ..... 53/167, 425, 426, 453, 127

See application file for complete search history.

(56) References Cited

U.S. PATENT DOCUMENTS 4,457,892 A * 7/1984 Young ..... 422/2
5,012,727 A * 5/1991 Pesente ..... 99/470

(Continued)

FOREIGN PATENT DOCUMENTS

DE 619492 10/1935
DE 641694 2/1937

(Continued)

OTHER PUBLICATIONS

Russian Office Action 2010102992/05.
English translation of Russian Office Action 2010102992/05 (004034).

*Primary Examiner* — Sameh Tawfik
(74) *Attorney, Agent, or Firm* — Nils H. Ljungman & Associates

(57) ABSTRACT

A container cleaning machine with a container or bottle cleaning apparatus with a spray pipe and spray station with a spray pipe of this type. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

14 Claims, 17 Drawing Sheets

(56) References Cited

U.S. PATENT DOCUMENTS

| | | | | | |
|---|---|---|---|---|---|
| 5,152,968 | A * | 10/1992 | Foti et al. | 422/304 |
| 6,135,015 | A * | 10/2000 | Mendez | 99/453 |
| 6,142,065 | A * | 11/2000 | Panella et al. | 99/468 |
| 6,374,575 | B1 * | 4/2002 | Strohn et al. | 53/288 |
| 6,475,435 | B1 * | 11/2002 | Taggart | 422/33 |
| 7,784,248 | B2 * | 8/2010 | Andersson | 53/425 |
| 8,020,360 | B2 * | 9/2011 | Biotti et al. | 53/512 |

FOREIGN PATENT DOCUMENTS

| | | | |
|---|---|---|---|
| DE | 10045932 | | 3/2002 |
| DE | 203 04 878 | U1 | 6/2003 |
| DE | 10315866 | | 10/2004 |
| GB | 789214 | | 1/1958 |
| JP | 3080976 | A | 4/1991 |
| JP | 2002153777 | A | 5/2002 |
| WO | WO 03084685 | | 10/2003 |

* cited by examiner

CONTAINER CLEANING MACHINE WITH A CONTAINER OR BOTTLE CLEANING APPARATUS WITH A SPRAY PIPE AND SPRAY STATION WITH A SPRAY PIPE OF THIS TYPE

CONTINUING APPLICATION DATA

This application is a Continuation-In-Part application of International Patent Application No. PCT/EP2008/004916, filed on Jun. 19, 2008, which claims priority from Federal Republic of Germany Patent Application No. 10 2007 030 220.9, filed on Jun. 29, 2007. International Patent Application No. PCT/EP2008/004916 was pending as of the filing date of this application. The United States was an elected state in International Patent Application No. PCT/EP2008/004916.

BACKGROUND

1. Technical Field

The present application relates to a container cleaning machine with a container or bottle cleaning apparatus with a spray pipe and spray station with a spray pipe of this type.

2. Background Information

Background information is for informational purposes only and does not necessarily admit that subsequently mentioned information and publications are prior art.

At least one possible embodiment of the present application relates to a spray pipe for use in cleaning machines, container or bottle cleaning machines, as well as to a spray station.

Cleaning machines are known, generally also such machines for bottles or containers or the like. Between a container feed and a container output, such machines have several treatment zones, through which the bottles or containers are moved with a conveyer inside the machine. The containers are, generally, each individually arranged in container or bottle cells of the conveyer inside the machine. Some treatment zones are, in each case, formed as a spray station, in which the bottles or containers with the bottle or container mouth thereof orientated downwards are treated or sprayed down internally with jets of a liquid spray or cleaning medium that come out of spray nozzles. In at least one possible embodiment of the present application, in the case of a continuously driven conveyer inside a machine, it is normal to form the spray nozzles in such a manner that the jets coming out therefrom are moved simultaneously or essentially simultaneously by pivoting with the containers in order to achieve a sufficiently long treatment duration, and that the spray nozzles are opened and closed in a controlled manner, such that a spray jet is only or essentially only delivered in each spray stage when a container carrier moves past the spray nozzle concerned or is located in the action range thereof. For this purpose, it is generally known to provide a plurality of spray nozzles on a spray or distributor pipe, and each of a nozzle member, attached to the distributor pipe, which forms a first nozzle channel, connecting with the interior of the distributor pipe, with a first control opening, as well as of a spray or nozzle shaft which is common to all or essentially all spray nozzles on the spray or distributor pipe, which shaft is provided with, in each case, a second nozzle channel forming the spray or nozzle opening as well as a second control opening, and such that whenever, during the rotation or pivoting of the nozzle shaft, both control openings overlap, i.e. during a spray stage or a spray angle defined through this overlap, the spray nozzle opens to deliver a spray jet, otherwise it is closed.

OBJECT OR OBJECTS

An object of at least one possible embodiment of the present application is to disclose a spray pipe, which comprises a simplified structural design and/or an improved treatment effect.

SUMMARY

According to at least one possible embodiment of the present application, the cross-sections of the control openings of the respective spray nozzle are formed such that at the beginning of each spray stage or each spray angle, i.e. when the spray nozzle first opens, an extremely steep increase in the spray or cleaning medium volume flow, coming out of the nozzle as a jet, over time is obtained and/or, at the end of the spray stage or spray angle, an extremely steep decrease in this volume flow over time is obtained, in order to introduce as much spray or cleaning medium as possible, in the respective spray stage, via the relevant spray nozzle into the container to be treated.

In the context of the present application, the term "complementary" should be understood to mean "supplementary," and such that the control openings to be moved onto one another, or to at least be partially aligned, supplement each other in such a way that as steep an increase and/or decrease as possible in the volume flow flowing through the control openings is achieved.

For this purpose, at least the cross-sections of the control openings that co-operate when the respective spray nozzle opens and closes are adapted accordingly to one another and such that the first or second control opening respectively is formed, on the front and/or rear cross-section side thereof based on the relative movement between the control openings during opening and closing, in a complementary or substantially complementary manner to the corresponding front and/or rear cross-section side of the second or first control opening.

This complementary or substantially complementary formation means, according to at least one possible embodiment of the present application, that if for example the second control opening has, on the front and/or rear (in terms of relative movement) cross-section side thereof, a concave, for example circular arc-shaped opening edge, the first control opening has a convex opening edge on the corresponding cross-section side, or vice versa.

Also, in accordance with at least one possible embodiment of the present application, a complementary or substantially complementary formation should be taken to mean an arrangement wherein the control openings have substantially straight or linear borders, and are formed for example as rectangles or triangles.

Through the use of modem manufacturing methods, such as 4-axis wire-cut EDM, laser cutting, die-sinking electric discharge machining, etc, control openings with concave and/or convex and/or linear peripheries or peripheral surfaces can be manufactured even in thick materials and work pieces, such as nozzle shafts.

To carry out at least one possible embodiment of the present application, it is not absolutely necessary for said cross-section sides or edge areas to complement each other in a mathematically exact manner with respect to the contour thereof, although this represents an optimum implementation of the teaching according to at least one possible embodiment of the present application. However, even a substantially complementary contour is sufficient.

The special shape of the control openings means that, at the start of the respective spray stage or of the respective spray angle, the relevant spray nozzle opens almost immediately or essentially immediately with a relatively large opening cross-section and, at the end of the respective spray stage or of the respective spray angle, closes extremely quickly or abruptly with what is initially still a large opening cross-section.

According to another aspect of at least one possible embodiment of the present application, each spray nozzle is formed by the nozzle member, the nozzle shaft and a bearing part, which overlaps, in a bow-like manner, the nozzle shaft at the side thereof facing away from the nozzle member, secures the nozzle shaft to the respective nozzle member and supports it, as well as, in the case of a plurality of second nozzle channels provided in the nozzle shaft for each spray nozzle, closes the nozzle channels that are not orientated, when the nozzle shaft rotates or pivots, in the direction of action of the relevant spray nozzle. To simplify the construction and assembly, these bearing members are held on the relevant nozzle member by locking. Costly screw connections, for example, are therefore avoided or at least may be avoided in at least one possible embodiment of the present application.

At least one possible embodiment of the present application relates to a spray pipe for use in a spray station of a cleaning machine, in at least one possible embodiment of the present application, a bottle or container cleaning machine, with a distributor pipe for supplying a liquid spray or cleaning medium, with a plurality of spray nozzles which are provided on the distributor pipe and in each case consist of a nozzle element which is held on the distributor pipe and has at least one first nozzle channel connecting with the interior of the distributor pipe and forming a first control opening, as well as of a nozzle shaft which is common to all nozzles or a group of several nozzles, which has, for each spray nozzle, at least one second nozzle channel forming a nozzle opening as well as a second control opening in such a manner that, during the rotation or pivoting of the nozzle shaft about the axis thereof, the respective nozzle opens over at least one angle range of the rotational movement of the nozzle shaft, in which (angle range) the at least one first and the at least one second control opening overlap one another, for the delivery of a jet of the spray or cleaning medium, but closes outside of this at least one angle range or spray angle for the delivery of the spray or cleaning medium, wherein the nozzle shaft lies with the periphery thereof on a bearing surface of the nozzle member, which surface has the at least one first control opening, and is secured to the nozzle member through a bearing part overlapping the nozzle shaft at a peripheral area facing away from the bearing surface, wherein the bearing part is held on the nozzle member through locking or a spray pipe for use in a spray station of a cleaning machine, in at least one possible embodiment of the present application, a bottle or container cleaning machine, with a distributor pipe for supplying a liquid spray or cleaning medium, with a plurality of spray nozzles which are provided on the distributor pipe and in each case consist of a nozzle element which is held on the distributor pipe and has at least one first nozzle channel connecting with the interior of the distributor pipe and forming a first control opening, as well as of a nozzle shaft which is common to all nozzles or a group of several nozzles, which has for each spray nozzle at least one second nozzle channel forming a nozzle opening as well as a second control opening in such a manner that, during the rotation or pivoting of the nozzle shaft about the axis thereof, the respective nozzle opens over at least one angle range of the rotational movement of the nozzle shaft, in which (angle range) the at least one first and the at least one second control opening overlap one another, for the delivery of a jet of the spray or cleaning medium, but closes outside of this at least one angle range or spray angle for the delivery of the spray or cleaning medium, wherein the cross-section shape of the at least one first control opening or of the at least one second control opening is selected such that the first control opening or the second control opening has, at a front and/or rear cross-section side based on an axial direction in which the control openings are moved relative to one another for opening or closing, a shaping that is complementary or substantially complementary to the shape of the second or first control surface. is formed to solve this problem. At least one possible embodiment of the present application relates to a spray station with at least one spray pipe, which is held at both ends at longitudinal pipes of a support frame and connected with the longitudinal pipes, wherein the spray pipe is formed.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

Developments, advantages and possible uses of at least one possible embodiment of the present application also emerge from the following description of embodiment examples and from the figures. All or essentially all features described and/or illustrated, separately or in any combination are, in principle, the subject matter of at least one possible embodiment of the present application, independent of the summary thereof in the claims or the back-referencing thereof.

BRIEF DESCRIPTION OF THE DRAWINGS

At least one possible embodiment of the present application is described in more detail below using the figures of an example of an embodiment, wherein.

DESCRIPTION OF EMBODIMENT OR EMBODIMENTS

To simplify the explanation, the three spatial axes running perpendicular or essentially perpendicular to one another, namely the X-axis, Y-axis and Z-axis, are also shown in the figures.

The spray station, which is generally designated with 1 in the figures, is for example a component of a cleaning machine, for example a bottle or container cleaning machine, and is arranged in this machine's interior, formed by a closed housing, under a conveying line, on which the containers or bottles B to be cleaned are moved past with the container opening thereof pointing downwards and arranged in bottle carriers or holders, and in a conveying direction (Y-axis) designated with the arrow A in the figures.

Figure 1:
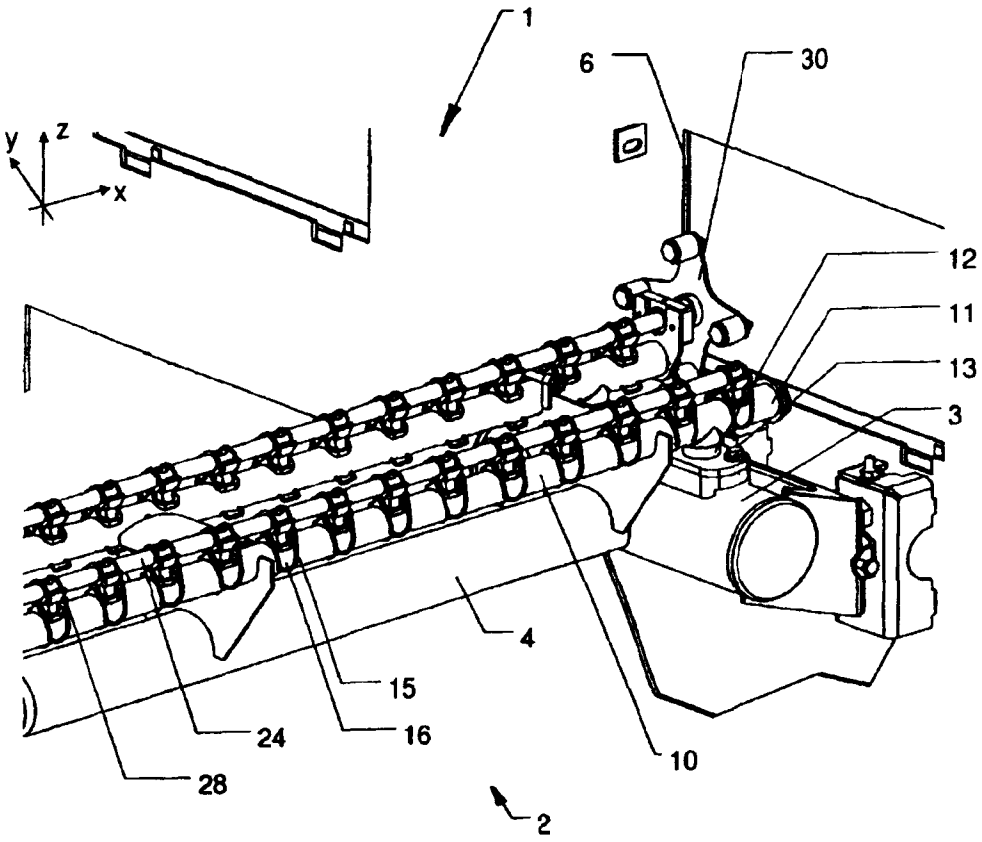
FIG. 1 is a perspective partial diagram of a spray station with a total of four spray pipes, according to at least one possible embodiment of the present application.
Figure 2:
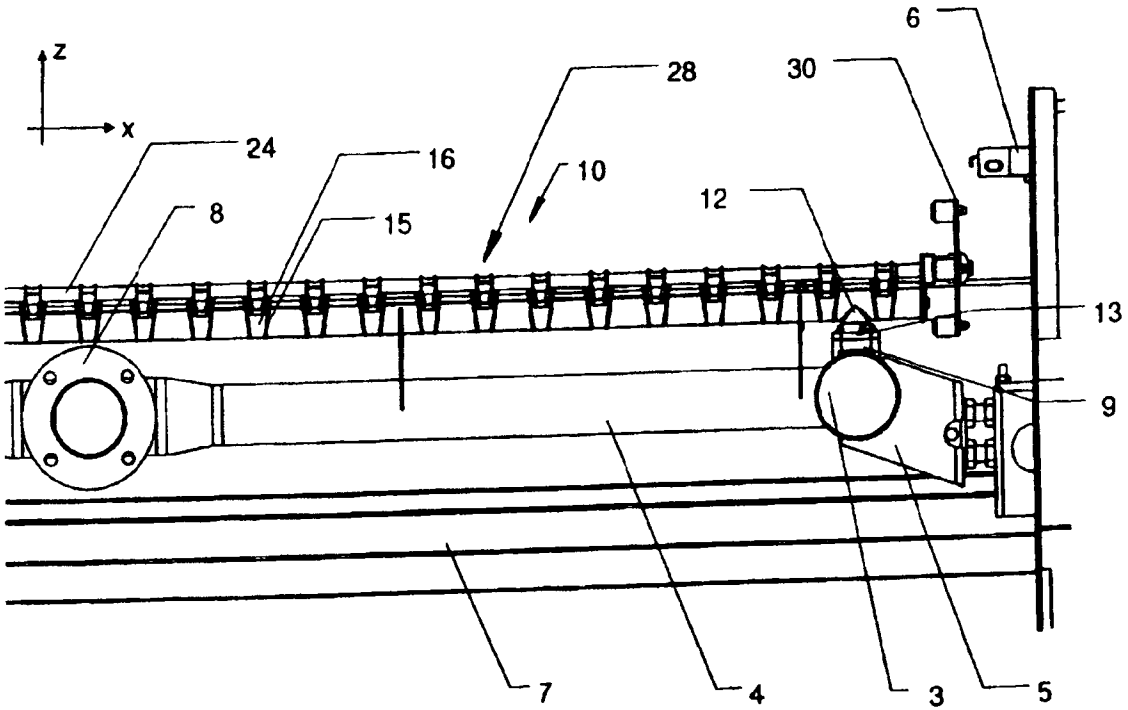
FIG. 2 is a partial front view diagram of the spray station in FIG. 1.

The spray station 1 in this case is fixed in the cleaning machine or in the spray station 30 thereof, i.e. it is not provided in a manner where it moves along with the conveying member for the bottles or containers B and is formed as a complete, functioning unit, which can be mounted as such in the machine. It consists substantially of a lower support frame 2 in FIGS. 1 and 2, which is formed, for example, by two longitudinal pipes 3 spaced apart from each other and parallel or substantially parallel to one another and by a cross-pipe 4 interconnecting these longitudinal pipes in the middle thereof, which is orientated with the length thereof (Y-axis') perpendicular or substantially perpendicular to the length (X-axis) of the longitudinal pipe 3. The two longitudinal pipes 3 are each accommodated with a part of the periphery thereof in a recess or a cutting of the cross-pipe 4 and connected tightly and outwardly at this point with the cross-pipe, such that the longitudinal pipes 3 which are closed, in each case, at both ends as well as the cross-pipe 4 which is closed at both ends form channels for supplying the liquid spray medium (for example water or water with cleaning additives or lye). The cross-pipe 4 protrudes with both the closed ends thereof beyond the longitudinal sides, which face away from each other, of the longitudinal pipes 3 and is at this point 10 provided with a flange 5 or such attachment means, and for attaching the support frame 2 to side walls 6 of a ground unit 7, which also serves, for example, as a distributor for the spray or cleaning medium. The cross-pipe 4 is connected in the center with the ground unit 7 via a pipe connection S. In the illustrated embodiment, the ground unit 7 is located in the direction of the Z-axis below the cross-pipe 4 and this is below the two longitudinal pipes 3.

On the top side facing away from the cross-section 4, each longitudinal pipe 3 is provided with a number of connecting flanges 9, which are provided successively in the illustrated embodiment in regular intervals in the direction of the Y-axis, and such that each connecting flange 9 on a longitudinal pipe 3 faces, in the direction of the X-axis, a connecting flange on the other longitudinal pipe 3, such that the connecting flanges 9 assigned to each other in each case form a connecting flange pair.

A spray pipe 10 is attached at both ends to each connecting flange pair, which pipe is arranged in the direction of the Z-axis above the support frame 2 and consists, for example, of a distributor pipe 11 closed at both ends and arranged in the mounted state with the length thereof in the X-axis and therefore parallel or substantially parallel to the cross-pipe 4, which distributor pipe is provided in the area of the two closed ends thereof with a radially protruding connecting piece 12 with a connecting flange 13, and for producing a mechanical connection as well as a tight liquid connection between the respective longitudinal pipe 3 and the distributor pipe 11.

It appears from the figures that "(Y-axis)" in this sentence should be "(X-axis)" and vice versa.

The distributor pipe 11 having a substantially circular inner and outer cross-section is provided, at the top side thereof facing away from the radially protruding connecting pieces 12, with a plurality of bores or openings 14, which, in the illustrated embodiment, follow one another in regular intervals in the longitudinal direction of the distributor pipe 11 (X-axis). In the area of each bore 14, the distributor pipe 11 is provided with two rib-type projections 15 protruding beyond the peripheral surface of the distributor pipe, which projections surround the distributor pipe 11, in each case, in a ring-like manner on the entire periphery, though in planes that are inclined with respect the longitudinal axis of the distributor pipe 11 in such a manner that the ring-shaped groove 16 formed between each 10 pair of projections 15 has a width which is widest at the top side of the distributor pipe 11, therefore at the point where the respective bore 14 is provided inside the respective groove 16, and this width reduces towards the underside of the distributor pipe 11.

Figure 3:
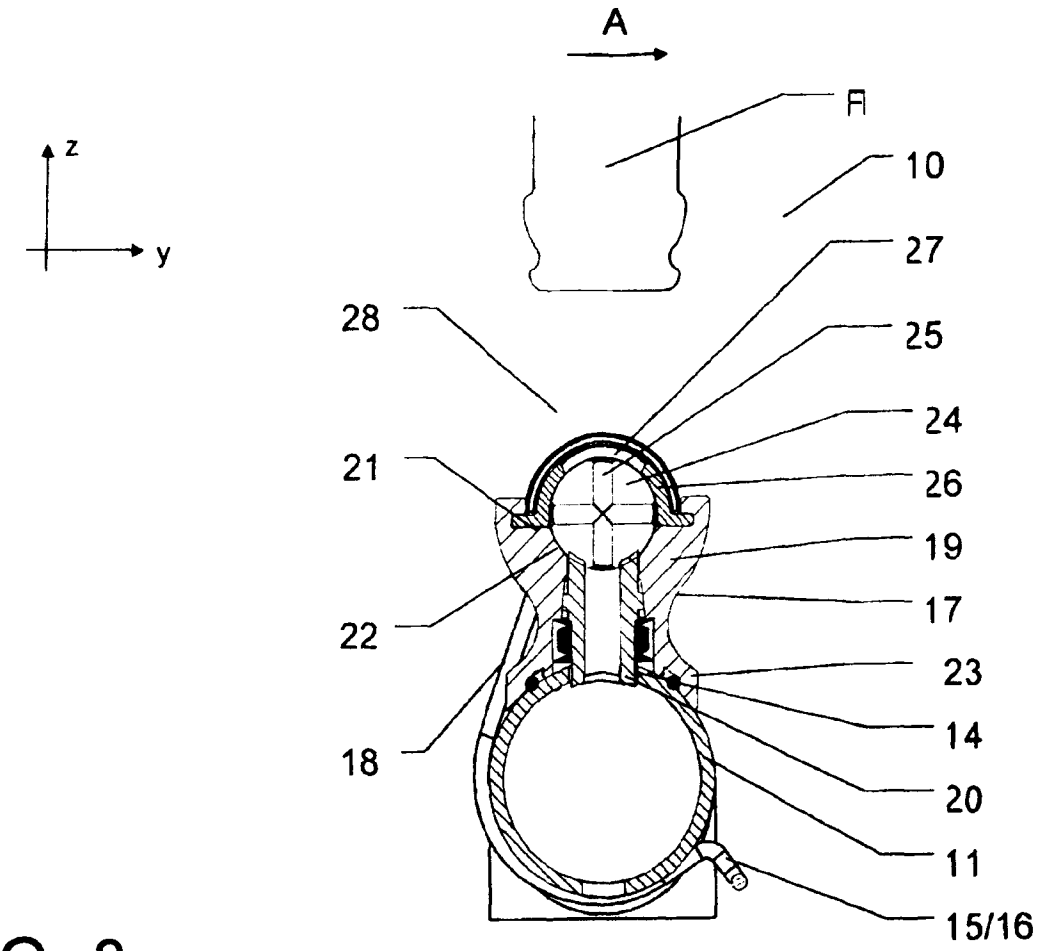
FIG. 3 is an enlarged diagram of a section according to line I-I of FIG. 1.

A nozzle member 17, which is formed for example as a molded part made from plastic, is inserted into each bore 14 in a sealed manner and suitably attached, for example through locking, gluing, plastic deforming, press-fitting etc. As illustrated in FIG. 3, the respective nozzle member 17 is formed substantially in a sleeve-like manner and with a sleeve body 19 forming a continuous nozzle channel 18, which body, when the nozzle member 17 is mounted, extends with an open sleeve body end 20 into the interior of the distributor pipe 11. At the sleeve end 21 radially protruding beyond the top side of the distributor pipe 11 or at the nozzle channel 18 end there which is open and forms a control opening, the sleeve body 20 is provided with a sealing and bearing surface 221 which is formed with a partly circular cylindrical shape, and about an axis that is parallel or substantially parallel to the length of the distributor pipe 11. For a torsionally secure and positionally accurate arrangement on the distributor pipe 11, each nozzle member 17 is further provided with two sections 23 protruding, like wings, beyond the outer surface of the sleeve body 19, which sections are provided in a manner in which they are mutually offset about the axis of the nozzle channel 18 by one hundred eighty degrees, are flush against the outer surface of the distributor pipe 11 when the nozzle member 17 is mounted and are, in each case, accommodated between the two projections 15 in an appropriate manner. The sections 23 define, on the one hand, the insertion depth of each nozzle member 17 into the associated bore 14 and secure, on the other, the nozzle member 17 against twisting in the bore 14. When the respective nozzle member 17 is inserted into the bore 14, the sections 23 are clamped in the groove having the bore 14 due to the course of the projections 15 and the shaping of the grooves 16.

Each spray pipe 10 further comprises a nozzle shaft 24 with a circular cylindrical outer diameter, which corresponds to the curvature of the bearing surface 22, but is smaller than the outer diameter of the distributor pipe 11. The nozzle shaft 24 is mounted on the bearing surfaces 22 in a lying manner on the nozzle members 17 and in one possible embodiment such that there is a liquid-tight or substantially liquid-tight closure of the respective nozzle channel 18 through the nozzle shaft 24. Provided in the nozzle shaft 24 are pairs, spaced apart from each other in the longitudinal direction of the nozzle shaft, of, in each case, two nozzle openings or channels 25 intersecting at right angles and orientated with the axes thereof radially to the nozzle shaft axis, and in one possible embodiment at an interval that is the same as the interval for the bores 14, such that each pair of nozzle channels 25 are located in the area of a nozzle channel 18 of a nozzle member 17.

Inter alia, to secure the nozzle shaft 24 to the bearing surfaces 22, a shell-like or bow-like bearing part 26 is attached to each nozzle member 17, which part is also manufactured as a molded part, for example from plastic, and tightly surrounds the nozzle shaft 24 at the area thereof projecting over the nozzle member 17 or over the bearing surface 22. The bow or clip-type bearing part 26 is held on the nozzle member 17 through locking and is provided on the side opposite the nozzle channel 18 with an opening 27, which has a cross-section that is larger than the cross-section of the bores forming the nozzle channels 25.

In a total of four angle ranges of the rotational movement of the nozzle shaft 24, there is therefore, for each controlled spray nozzle 28 formed by a nozzle member 17 and the nozzle shaft 24, in each case a nozzle channel 25 with the end thereof, forming a control opening, congruent both with the nozzle channel 18 or control opening at this location, and with the opening 27, such that, during this angle range (spray angle or spray stage) that opens the spray nozzle 28, a spray jet 29 pivoting with the rotational movement of the nozzle shaft 24 (arrow B) is obtained.

The respective nozzle shaft 24 extends over the entire length of the associated distributor pipe 11, projects with one end beyond the distributor pipe 11 and is provided there with a control or drive star, which is used to drive the respective nozzle shaft 24 synchronously VA with the movement of the conveyer moving the bottles or containers B past the spray station 1. The distributor pipes 11, the longitudinal pipes 3 as well as the cross-pipe 4 can each be opened for inspection and cleaning.

In at least one possible embodiment of the present application as seen in FIG. 3, the spray pipe arrangement 10 is configured to supply a blast of spray into returned bottles or containers to be cleaned prior to refilling or into new bottles or containers to be filled in a beverage bottling plant or a container filling plant. Cleaning medium may be supplied to the spray pipe arrangement 10 by a distributor pipe 11. The distributor pipe 11 comprises a plurality of bores or openings 14. The spray pipe arrangement 10 may also comprise a plurality of nozzle members 17. Each nozzle member 17 may correspond to one of a plurality of bores 14. In other words, one nozzle member 17 may be disposed along of each opening 14. The nozzle member 17 may be configured to spray cleaning medium, supplied by the distributor pipe 11, upwardly into the mouths of returned beverage bottles or containers or new beverage bottles or containers.

Each nozzle member 17 may comprise a nozzle chamber 18. Each nozzle chamber 18 may comprise a sleeve end 20 and a control opening 32. The control opening 32 may be disposed on the nozzle chamber 18 opposite the sleeve end 20. In one possible embodiment of the present application, the sleeve end 20 of the nozzle chamber 18 may abut the distributor pipe 11. The nozzle chamber 18 may then extend outwardly from the distributor pipe 11. The nozzle chamber 18 may be configured to permit the flow of cleaning medium from the distributor pipe 11 to the control opening 32, as shown in FIGS. 5B, 6A, 6B, 7, 8, and 9B.

A plurality of nozzle channels 25 may be disposed downstream of the control opening 32. The nozzle channels 25 may be disposed in a nozzle shaft 24. The nozzle shaft 24 may extend parallel or substantially parallel the length of the distributor pipe 11. The nozzle shaft 24 may be rotationally driven by a drive star 30.

For example, in one possible embodiment of the present application, two nozzle channels 25 may be disposed, in the nozzle shaft 24, at each control opening 32. One nozzle channel 25 may intersect perpendicularly or substantially perpendicularly with the other nozzle channel 25, in one possible embodiment to form a four-pointed star. Each of the nozzle channels 25 may be configured to permit the flow of cleaning medium from a control opening 32 to an opening 27, and out of the spray pipe arrangement 10.

An opening 27 may be disposed downstream of the nozzle chamber 18 and nozzle shaft 24. The cross-section of the opening 27 may be larger than cross-section of each nozzle channel 25.

Each end of each nozzle channel 25 may comprise a control opening 33, as shown in FIGS. 5A, 6A, 6B, 7, 8, and 9A. Upon rotation of the nozzle shaft 24, a control opening 33 of a nozzle channel 25 may be rotated past the control opening 32 of the nozzle chamber 18. When the control opening 32 is rotated to at least partially overlap the control opening 33, cleaning medium may then flow from the distributor pipe 11, through the nozzle chamber 18, through the control opening 32, through the control opening 33, through the nozzle channel 25, out of the spray pipe arrangement 10 through the opening 27, and into the mouths of bottles and containers.

Figure 4:
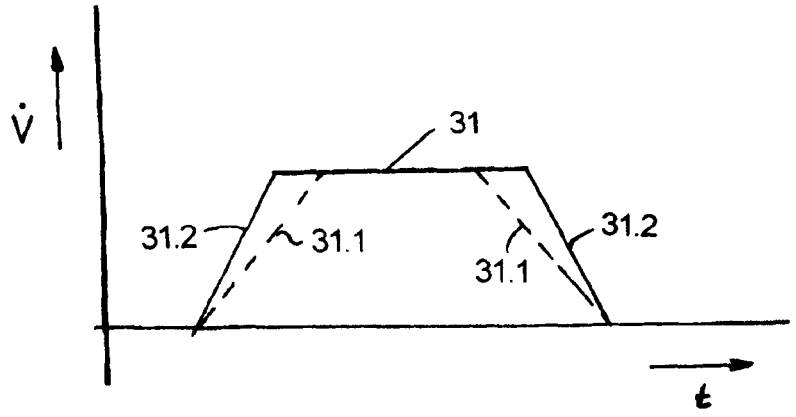
FIG. 4 shows the progression over time of the volume flow produced from a spray nozzle during a spray angle or a spray stage.

FIG. 4 shows a diagram of the progression over time of the liquid spray medium amount V delivered during a spray stage via the respective spray jet 29. As illustrated in FIG. 4 with the curve 31, the volume flow produced increases at the start of the respective spray stage initially, then reaches a peak and subsequently decreases again.

The curve 31 with the increasing and decreasing slopes 31.1 applies, for example, when the nozzle channel 18 and the nozzle channels 25 are formed with a circular cross-section. While retaining the temporal beginning and the temporal end of the respective spray stage and therefore in at least one possible embodiment of the present application also while retaining the spray duration, the objective is, however, to increase the steepness of the slopes both at the beginning and at the end of the respective spray stage, as indicated in FIG. 4 with the curve 31.2, in order to increase the spray liquid amount actually produced in each spray stage and therefore the treatment intensity.

To this end, at least one of the two control openings then has a cross-section that deviates from the circular shape. Both control openings are adapted to one another in such a manner that the cross-section of one control opening has, at the front and/or rear edge area thereof, in relation to the rotating direction of the nozzle shaft 24 (arrow B), a shaping which is complementary or substantially complementary to the shaping of the cross-section of the other control opening in such a manner that the corresponding spray nozzle 28 is opened at the beginning of each spray stage, as soon as the control openings first overlap, with an enlarged flow cross-section and at the end of each spray stage remains open with an enlarged flow cross-section until the control openings no longer overlap.

An example is illustrated in FIG. 5 for the control openings designated with 32 and 33. The control opening 32 is, for example, the control opening formed by the nozzle channel 18 in the area of the bearing surface 22. The control opening 33 is then the control opening formed by the respective nozzle channel 25. The control opening 33 has a circular cross-section. The shape of the control opening 32 can be described such that it corresponds to a circular opening with the radius of the control opening 33, though with a constriction or with projections 32.1 that form it, at the cross-section sides that are leading and lagging with respect to rotating direction B of the nozzle shaft 24, wherein each projection 32.1 is produced in a circular arc shape with a radius corresponding to the radius of the control opening 33. As a result of this formation of the control openings 32 and 33, the respective spray nozzle 28 is closed so long as the control openings 32 and 33 do not overlap. When they first overlap, the nozzle 28 is opened already with an enlarged cross-section and also remains open until shortly before closure with an enlarged cross-section, such that the steeper slopes 31.2 occur.

Further examples of a control opening arrangement according to at least one possible embodiment of the present application are illustrated in FIG. 6. Herein, the arrangement with the control openings 32, 33 formed with a substantially rectangular shape is in one possible embodiment of the present application advantageous since the maximum width of the control openings immediately or essentially immediately becomes effective when the control openings are covered.

At least one possible embodiment of the present application is described above using one embodiment example. Of course, a number of changes and modifications can be made without departing from the basic principle of at least one possible embodiment of the present application.

The subject matter of at least one possible embodiment of the present application therefore also extends to such arrangements wherein not only the actual control openings in accordance with at least one possible embodiment of the present application are formed in a complementary manner, but also the bores or perforations assigned to the openings. Therefore, also according to at least one possible embodiment of the present application for example, the bores or perforations that are placed in the nozzle shafts 24 and guide the treatment liquid are completely formed with a cross-section surface according to at least one possible embodiment of the present application, which allows for the reduction of flow losses.

Figure 5B:
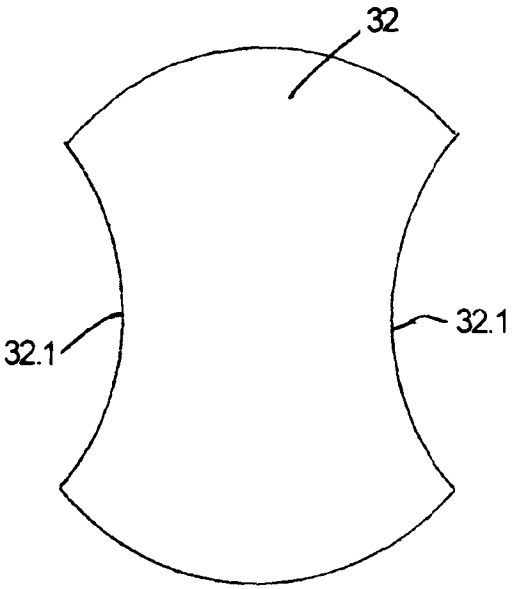
FIG. 5 is an enlarged diagram of the cross-section of the control openings of an at least one possible embodiment of a spray nozzle.
Figure 5A:
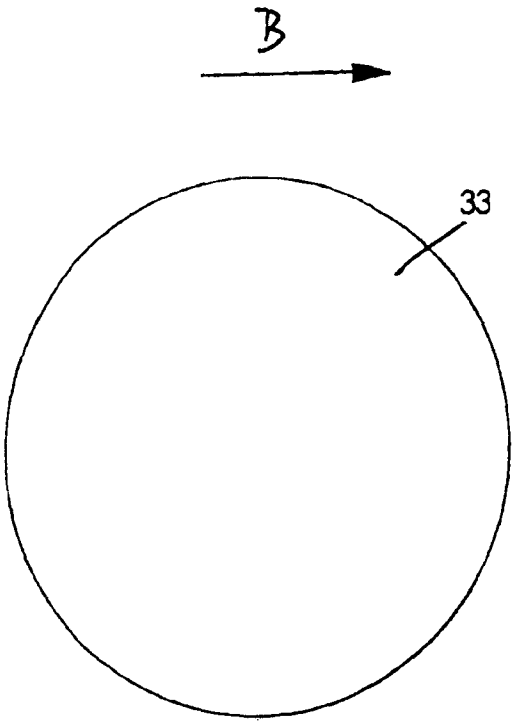
Figure 6A:
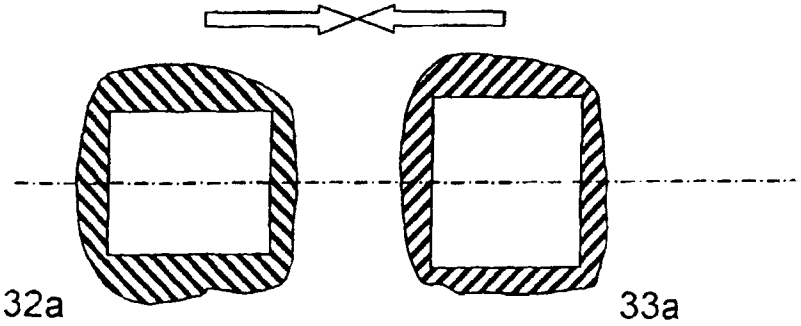
FIG. 6 is an enlarged diagram of the cross-section of the control openings of further possible embodiments of spray nozzles.
Figure 6B:
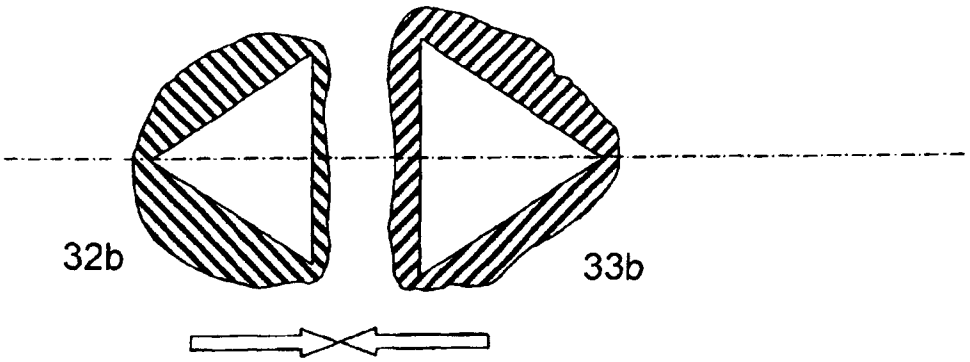
Figure 9A:
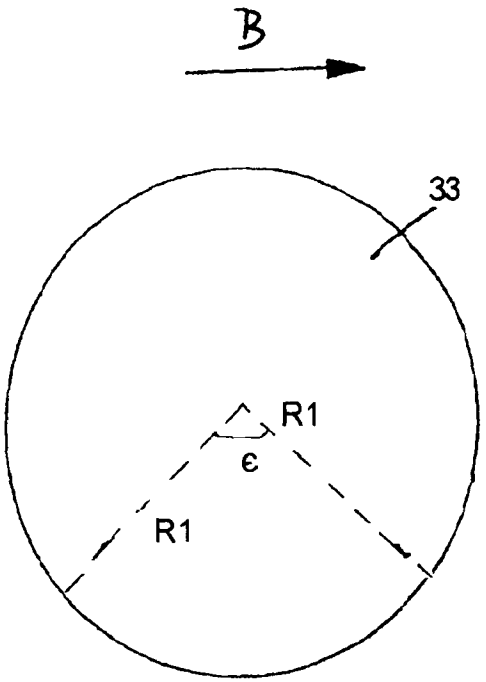
FIG. 9A shows another possible embodiment of the cross-section of a control opening of the present application.
Figure 9B:
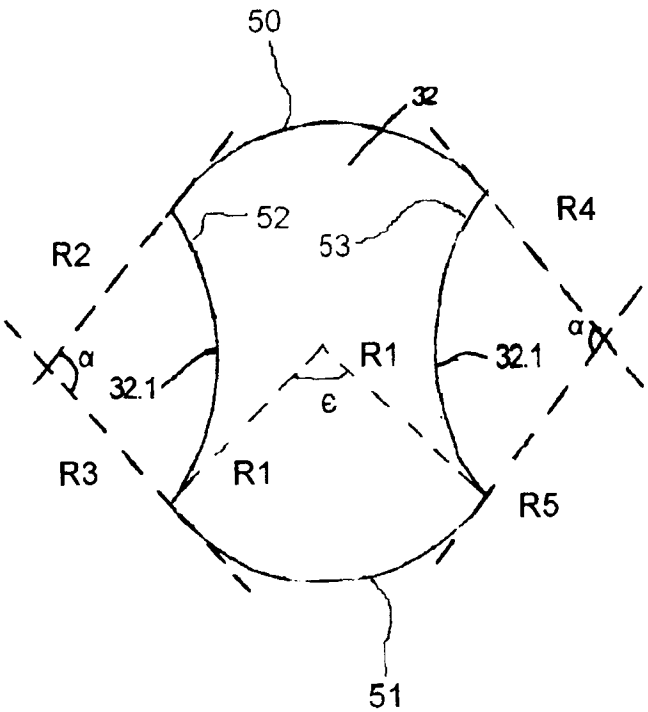
FIG. 9B shows another possible embodiment of the cross-section of a control opening of the present application.
Figure 10:
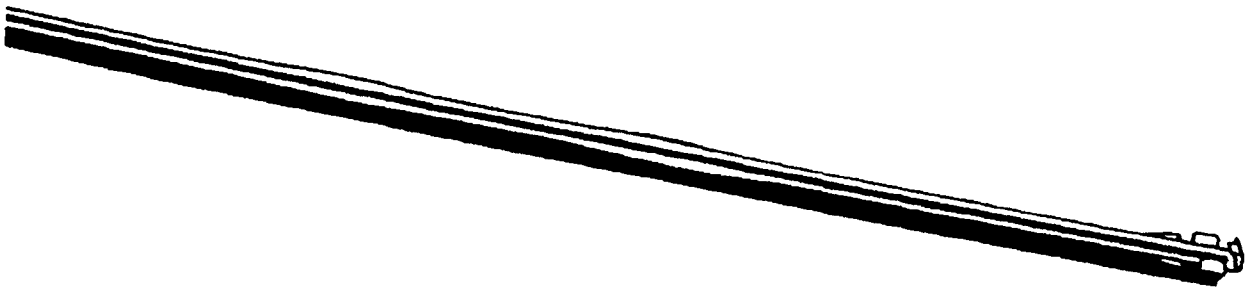
FIG. 10 shows one possible embodiment of a locking feature for use with the present application.
Figure 11:
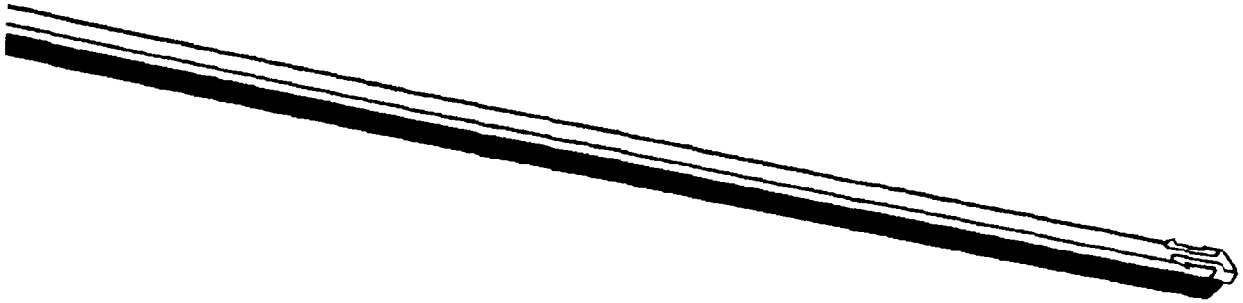
FIG. 11 shows another possible embodiment of a locking feature for use with the present application.
Figure 12:
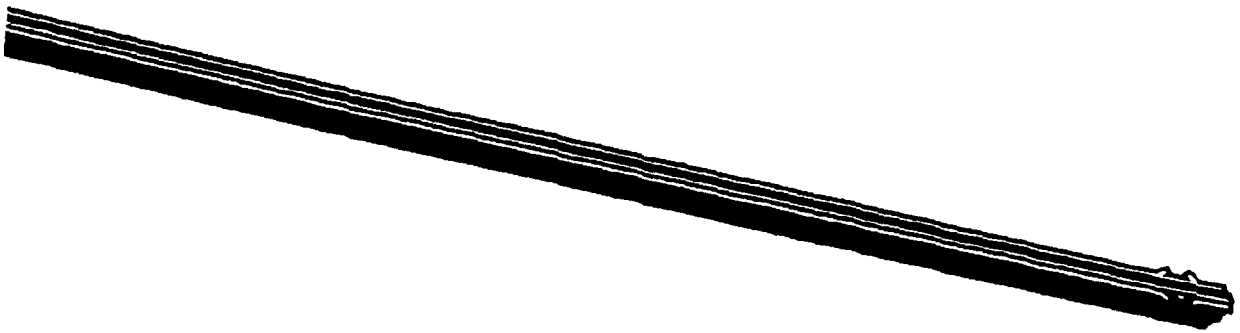
FIG. 12 shows another possible embodiment of a locking feature for use with the present application.
Figure 13:
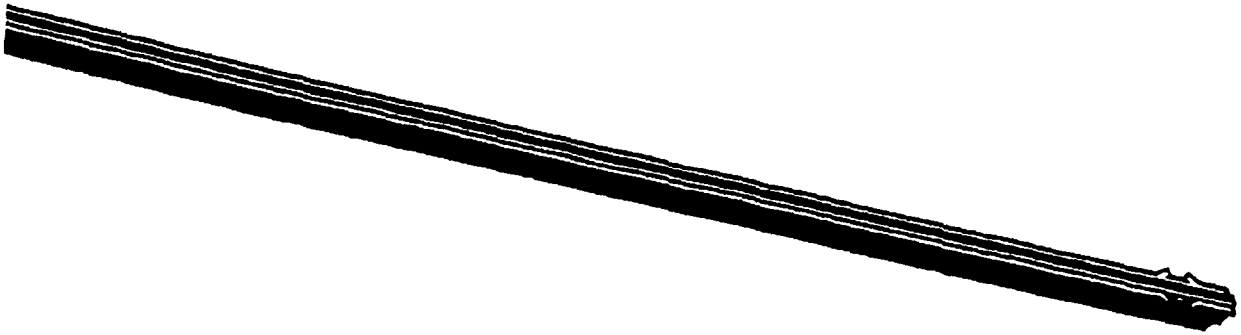
FIG. 13 shows another possible embodiment of a locking feature for use with the present application.
Figure 14:
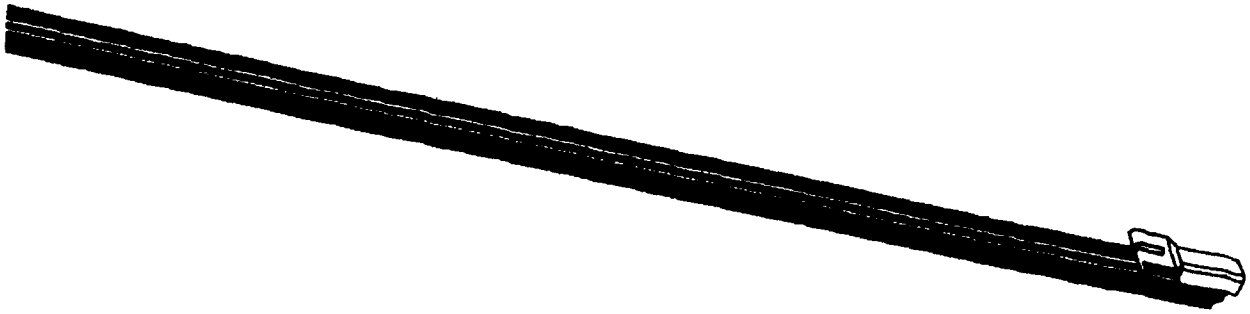
FIG. 14 shows another possible embodiment of a locking feature for use with the present application.

In FIGS. 5A and 9A, in at least one possible embodiment of the present application, the control opening 33 may be configured to have the shape of a circle. The control opening 32 may be configured to have a shape that permits a substantial portion of the maximum flow of cleaning medium supplied from the nozzle chamber 18. In one possible embodiment, this shape of the control opening 32 may comprise a circle, with the same radius of curvature R1 of the circular control opening 33, with projections 32.1 curving inwardly toward the center of the control opening 32. The projections 32.1 may reduce the cross-section of the control opening 32, so that the cross-section of the control opening 32 may be less than the cross-section of the circular control opening 33. Each curved projection 32.1 comprises the same radius of curvature R1 as the circular control opening 33. The angle $\epsilon$, as shown in FIGS. 9A and 9B, in one possible embodiment may be about eighty-six degrees. The angle $\epsilon$ may vary in one degree increments or less. The angle $\epsilon$ may vary. For example, in one possible embodiment of the present application, the angle $\epsilon$ may be less than eighty-six degrees. In another possible embodiment of the present application, the angle $\epsilon$ may be greater than eighty-six degrees. The angle $\epsilon$ may be chosen to provide a quick burst of cleaning fluid and maintain a rate of maximum flow when both openings 32 and 33 are fully overlapped.

In at least one possible embodiment of the present application, the circular control opening 33 is rotated over the stationary control opening 32. As the control opening 33 may begin to overlap the control opening 32, a pathway may be formed, which permits a sudden flow through the control openings 32 and 33. As the control opening 33 may continue to rotate over the control opening 32, the flow of cleaning medium may increase until a highest possible flow is reached until the control openings 32 and 33 fully overlap. Then, as the control opening 33 may continue to rotate over the control opening 32, the flow of cleaning medium may decrease until the control opening 33 moves past the control opening 32 and the formed pathway is then cut off.

As the circular control opening 33 is rotated over the control opening 32, a sudden path may be formed to provide a blast of cleaning medium through the spray pipe unit 10 sufficient to clean bottles and containers. The corresponding shapes of the control openings 32 and 33 may be configured to supply a greater flow and a more substantial flow than if both of the control openings 32 and 33 were both circles.

If both the control openings 33 and 32 were circular, when the openings 32 and 33 begin to overlap, a slight flow may first trickle through the openings 33 and 32. As the openings 32 and 33 begin to further overlap, a maximum flow of cleaning medium may be reached before the flow is slowly cut off until the openings 32 and 33 no longer overlap.

Figure 7:
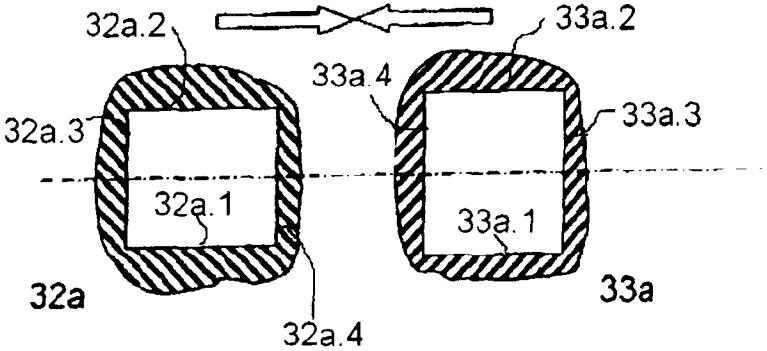
FIG. 7 shows another possible embodiment of the cross-section of control openings of the present application.

As seen in FIG. 7, in another possible embodiment according to the present application, the control openings 32*a* and 33*a* may comprise other shapes, such as rectangles. Control opening 32*a* comprises the shape of a rectangle, comprising a first length 32*a*.1 and a second length 32*a*.2. The lengths 32*a*.1 and 32*a*.2 may be similar or substantially different, depending on possible embodiments of the present application. Control opening 32*a* also comprises a first height 32*a*.3 and a second height 32*a*.4. The heights 32*a*.3 and 32*a*.4 may be similar or substantially different depending on possible embodiments of the present application. Control opening 33*a* also comprises a first length 33*a*.1 and a second length 33*a*.2. The lengths 33*a*.1 and 33*a*.2 may be similar or substantially different, depending on possible embodiments of the present application. Control opening 33*a* also comprises a first height 33*a*.3 and a second height 33*a*.4. The heights 33*a*.3 and 33*a*.4 may be similar or substantially different depending on possible embodiments of the present application. In one possible embodiment of the present application, the lengths 32*a*.4 and 33*a*.4 and the lengths 32*a*.3 and 33*a*.3 are similar, and the heights 33*a*.1 and 32*a*.1 and the heights 33*a*.2 and 32*a*.2 are similar. In another possible embodiment of the present application, the lengths 32*a*.4 and 33*a*.4 and the lengths 32*a*.3 and 33*a*.3 are substantially different, and the heights 33*a*.1 and 32*a*.1 and the heights 33*a*.2 and 32*a*.2 are substantially different. In yet another possible embodiment, the heights 33*a*.1 and 32*a*.1 and the heights 33*a*.2 and 32*a*.2 may be the same and the heights 33*a*.1 and 32*a*.1 and the heights 33*a*.2 and 32*a*.2 may be different, or the heights 33*a*.1 and 32*a*.1 and the heights 33*a*.2 and 32*a*.2 may be different and the heights 33*a*.1 and 32*a*.1 and the heights 33*a*.2 and 32*a*.2 may be the same.

Figure 8:
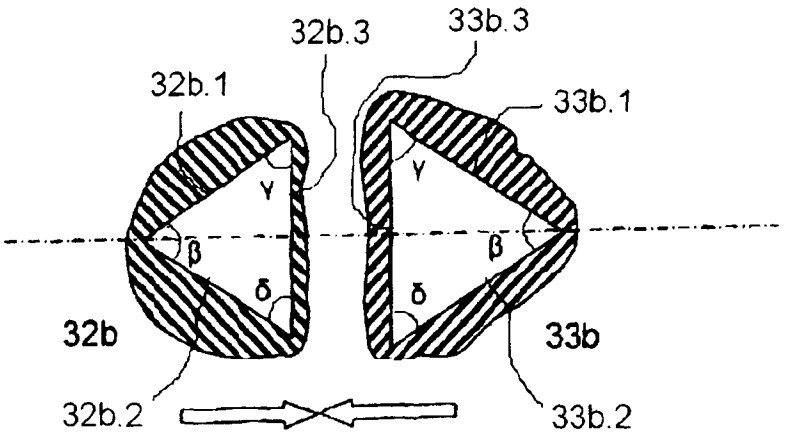
FIG. 8 shows another possible embodiment of the cross-section of control openings of the present application.

As seen in FIG. 8, in another possible embodiment according to the present application, the control openings 32*b* and 33*b* may comprise other shapes, such as triangles. For example, in at least one possible embodiment, each control opening 33*b* may comprise a triangular shape, and each control opening 32*b* may comprise a homologous triangular shape. Portions of the edges of the control openings may be congruous. For example, edges 32*b*.3 and 33*b*.3 may be congruous, edges 32*b*.1 and 33*b*.1 may be congruous, and edges 32*b*.2 and 33*b*.2 may be congruous. In other possible embodiments of the present application, the proportions of edges of the control openings 32*b* and 33*b* may vary.

In at least one possible embodiment of the present application, the angle β may be about sixty-five degrees, the angle γ may be about fifty-seven degrees, and the angle δ may be about fifty-eight degrees. In other possible embodiments, the angles β, γ, and δ may vary to form isosceles triangles or equilateral triangles or scalene triangles, which may or may not be congruous.

The angles β, γ, and δ of the triangular openings 32*b* and 33*b* may vary to maximize the burst of cleaning fluid exiting the control openings 32*b* and 33*b* when the openings 32*b* and 33*b* overlap and also minimize any wastage of cleaning fluid. The strong initial burst of cleaning medium may be sufficient to dislodge any particles inside the bottles or containers to be cleaned. The flow may then slowly be cut off as the control openings 33*b* and 32*b* are moved relative to one another until they no longer overlap to rinse away any dislodged particles.

The shapes of the control openings 32 and 33 may be configured to provide a steep increase in the flow of cleaning medium through the spray pipe arrangement 10 upon the initial overlap of the control openings 32 and 33 as the nozzle shaft 24 is rotated by the drive star 30. The shapes of the control openings 32 and 33 may also be configured to provide a steep decrease in the flow of cleaning medium through the spray pipe arrangement 10 upon the control openings 32 and 33 no longer overlapping.

The corresponding control openings 32 and 33 may prevent, restrict, and/or minimize any trickling of cleaning medium out of the spray pipe arrangement 10 and therefore may also prevent, restrict, and/or minimize any wastage of cleaning medium. In addition, the corresponding control openings 32 and 33 may promote a stream of cleaning medium which maximizes and promotes sufficient cleaning of bottles and containers.

In FIG. 9A, the circular control opening 33 comprises a radius R and an angle ϵ. The angle ϵ may be about eighty-six degrees.

In FIG. 9B, the radius R1 of the control opening 32 is equal or substantially equal to the R1 as seen in FIG. 9A. The radius R1 extends from the center of the control opening 32 to the convex arc 51. The radius R1 may also equally extend from the center of the control opening 32 to the convex arc 50. Similarly, the angle ϵ is equal or substantially equal to the angle ϵ as seen in FIG. 9A. Additionally seen in FIG. 9B are concave arcs 52 and 53, which form the protrusions 32.1. Also seen are tangents R2, R3, R4, and R5, which extend from the arcs 50 and 51. At the intersection of tangents R2 and R3, as well as at the intersection of tangents R4 and R5, an angle α is formed. In one possible embodiment of the present application the angle α may be about ninety-seven degrees. In another possible embodiment of the present application, the angles α and ϵ may be equal or substantially equal. In one possible embodiment, the radius R1 may be equal or substantially equal to one or more of the tangents R2, R3, R4, and R5. In another possible embodiment the radius R1 may be substantially different from one or more of the tangents R2, R3, R4, and R5.

FIGS. 10 through 14 show features which may possibly be utilized or adapted for use with the present application. These features may be used to clip the bearing part 26 onto the nozzle member 17. These features are also illustrated in the TRICO Stant Wiper Blade Refills brochure (STRI-7509) T-5015. TRICO is located at Trico Technology Center, 3255 W. Hamlin Road, Rochester Hills, Mich. 48309 USA.

Figure 15:
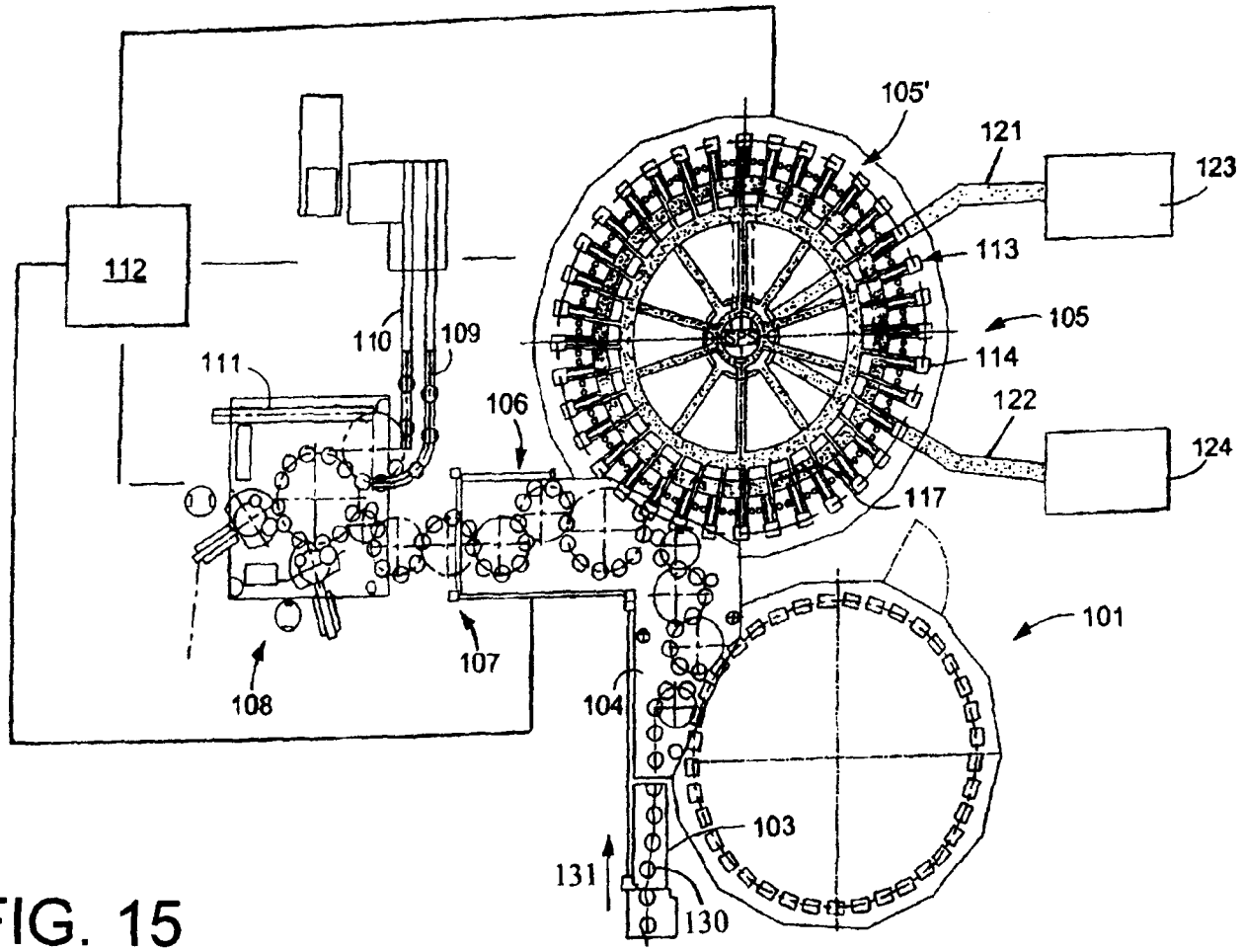
FIG. 15 shows schematically the main components of one possible embodiment example of a system for filling containers, in one possible embodiment, a beverage bottling plant for filling bottles with at least one liquid beverage, in accordance with at least one possible embodiment, in which system or plant could possibly be utilized at least one aspect, or several aspects, of the embodiments disclosed herein.

FIG. 15 shows schematically the main components of one possible embodiment example of a system for filling containers, specifically, a beverage bottling plant for filling bottles 130 with at least one liquid beverage, in accordance with at least one possible embodiment, in which system or plant could possibly be utilized at least one aspect, or several aspects, of the embodiments disclosed herein.

FIG. 15 shows a rinsing arrangement or rinsing station 101, to which the containers, namely bottles 130, are fed in the direction of travel as indicated by the arrow 131, by a first conveyer arrangement 103, which can be a linear conveyor or a combination of a linear conveyor and a starwheel. Downstream of the rinsing arrangement or rinsing station 101, in the direction of travel as indicated by the arrow 131, the rinsed bottles 130 are transported to a beverage filling machine 105 by a second conveyer arrangement 104 that is formed, for example, by one or more starwheels that introduce bottles 130 into the beverage filling machine 105.

The beverage filling machine 105 shown is of a revolving or rotary design, with a rotor 105', which revolves around a central, vertical machine axis. The rotor 105' is designed to receive and hold the bottles 130 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 130 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 15, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 130, the first product or the second product can be filled by means of an appropriate control of the filling product or fluid valves.

Downstream of the beverage filling machine 105, in the direction of travel of the bottles 130, there can be a beverage bottle closing arrangement or closing station 106 which closes or caps the bottles 130. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 130. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles 130 to different locations.

The first output conveyer arrangement 109, in the embodiment shown, is designed to convey bottles 130 that are filled with a first type of liquid beverage supplied by, for example, the supply reservoir 123. The second output conveyer arrangement 110, in the embodiment shown, is designed to convey bottles 130 that are filled with a second type of liquid beverage supplied by, for example, the supply reservoir 124. The third output conveyer arrangement 111, in the embodiment shown, is designed to convey incorrectly labeled bottles 130. To further explain, the labeling arrangement 108 can comprise at least one beverage bottle inspection or monitoring device that inspects or monitors the location of labels on the bottles 130 to determine if the labels have been correctly placed or aligned on the bottles 130. The third output conveyer arrangement 111 removes any bottles 130 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

Figure 16:
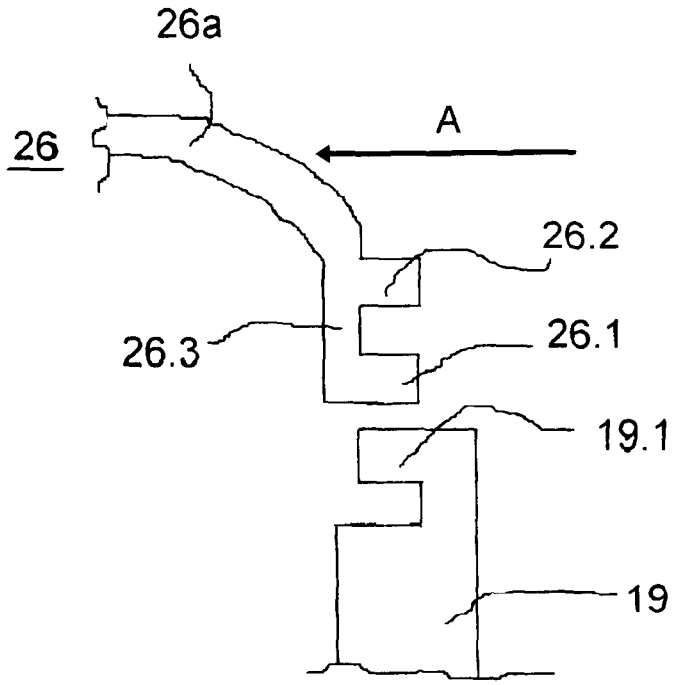
FIG. 16 shows a schematic representation of one possible embodiment of a bearing part configured to engage with a nozzle member.

FIG. 16 shows a schematic representation of one possible embodiment of the present application of the bearing part 26. The section 26*a* is connected to the bearing part 26, and comprises two projections 26.1 and 26.2 as well as a portion 26.3, which connects the projections 26.1 and 26.2. The projection 26.1 may be configured to retract in order to pass over the projection 19.1 of the sleeve body 19 of the nozzle member 17 as the section 26*a* is depressed into the sleeve body 19. The projection 19.1 may then engage with the portion 26.3 of the section 26*a* of the bearing part 26. The projections 26.1 and 26.2 may hold the section 26*a* in locking engagement with the projection 19.1 of the sleeve body 19 of the nozzle member 17, without the need for screws or screw connections.

Section 26*a* may comprise a flexible material, so that section 26*a* may move and bend in order to fit into place against the sleeve body 19. Section 26*a* may be depressed in the direction of the arrow A either by hand or by tool. The projection 26.1 may be slid past the projection 19.1 and into the slot, such that projections 26.1 and 26.2 rest on either side of the projection 19.1, keeping section 26*a* in locking engagement with the sleeve body 19. The section 26*a* may be depressed until the projection 26.1 clears the projection 19.1 and the section 26*a* engages with the sleeve body 19. To release the section 26*a* from locking engagement with the sleeve body 19, the section 26*a* may be depressed in the direction of the arrow and the section 26*a* may slid out of engagement with the projection 19.1.

Figure 17:
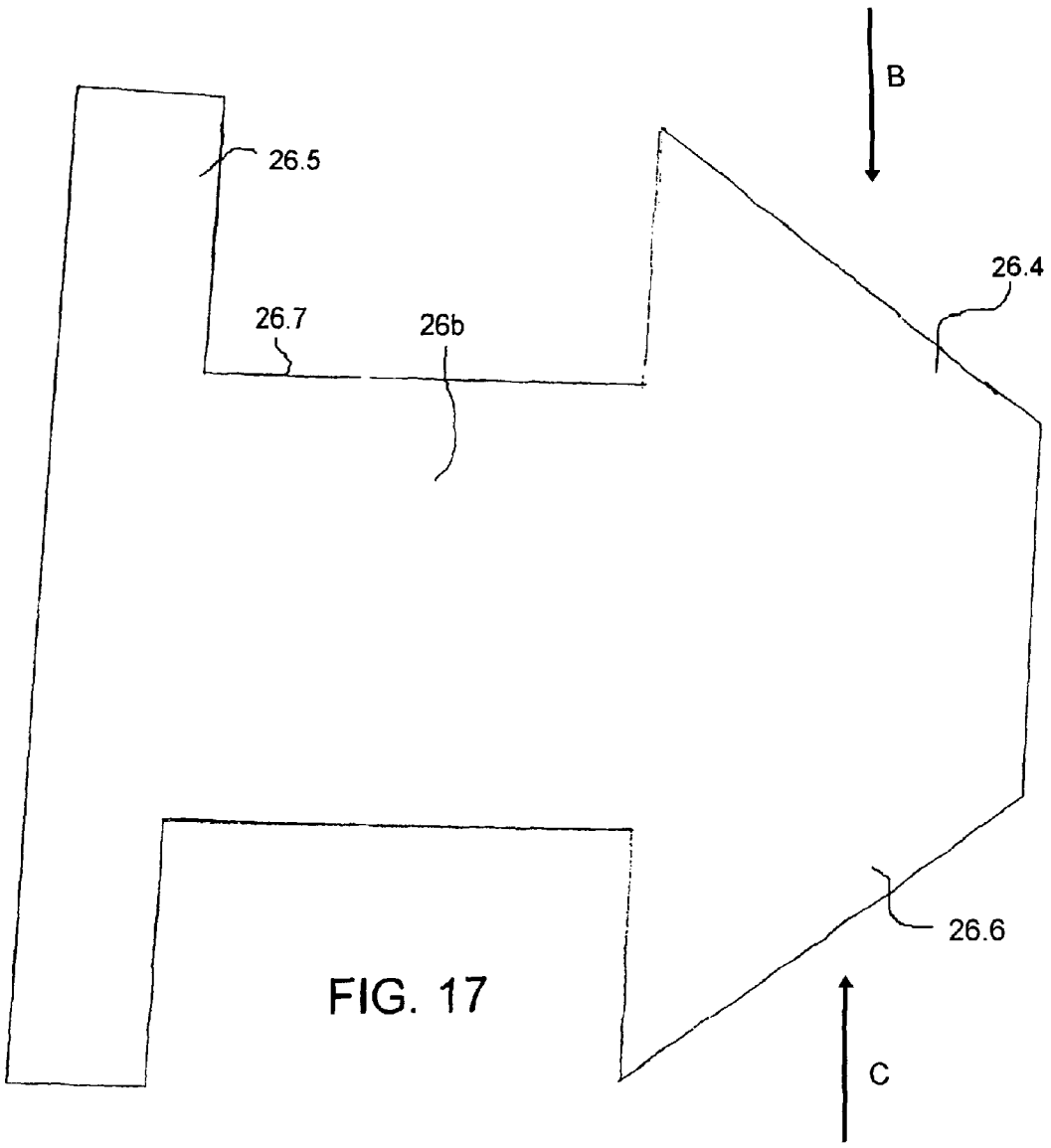
FIG. 17 shows a schematic representation of one possible embodiment of a bearing part of the present application.

FIG. 17 shows another schematic representation of one possible embodiment of the present application of the bearing part 26 and the section 26*b* of bearing part 26. The projections 26.4 and 26.6 may be configured to retract as section 26*b* is depressed into locking engagement with the nozzle member 17. Once the projections 26.4 and 26.6 are in place in the nozzle member 17, the projections 26.4 and 26.6 open and lock into place in the nozzle member 17. The length of the portion 26.7 is sufficient to permit the projections 26.4 and 26.6 to open from their retracted positions. The projection 26.5 may prevent, restrict, and/or minimize the section 26*b* of the bearing part 26 from sliding too far through the nozzle member 17. To remove the bearing part 26 from the nozzle member 17, the section 26*b* may be depressed to retract the projections 26.4 and 26.6 so the section 26*b* may be pulled out of locking engagement with the nozzle member 17.

The projection 26.4 may be depressed in the direction of the arrow B in order for the section 26*b* to be slid into engagement with the sleeve body 19. The projection 26.6 may be depressed in the direction of the arrow C in order for the section 26*b* to be slid into engagement with the sleeve body 19. The projections 26.4 and 26.6 may be depressed by the sleeve body 19 as section 26*b* is slid into the sleeve body 19. The projections 26.4 and 26.6 may be engaged in a slot in the sleeve body 19. Once the section 26*b* is in place in the sleeve body 19, the projections 26.4 and 26.6 may then pop out and lock into place against the sleeve body 19. To release the section 26*b*, the projections 26.4 and 26.6 may be depressed again so that the section 26*b* can slide out of the slot in the sleeve body 19.

One feature or aspect of an embodiment is believed at the time of the filing of this patent application to possibly reside broadly in a spray pipe for use in a spray station of a cleaning machine, in at least one possible embodiment of the present application, a bottle or container cleaning machine, with a distributor pipe 10 for supplying a liquid spray or cleaning medium, with a plurality of spray nozzles 28 which are provided on the distributor pipe 10 and in each case consist of a nozzle element 17 which is held on the distributor pipe 10 and has at least one first nozzle channel 18 connecting with the interior of the distributor pipe 11 and forming a first control opening 32, as well as of a nozzle shaft 24 which is common to all nozzles 28 or a group of several nozzles 28, which has, for each spray nozzle 28, at least one second nozzle channel 25 forming a nozzle opening as well as a second control opening 33 in such a manner that, during the rotation or pivoting of the nozzle shaft 24 about the axis thereof, the respective nozzle 28 opens over at least one angle range of the rotational movement of the nozzle shaft 24, in which (angle range) the at least one first and the at least one second control opening 32, 33 overlap one another, for the delivery of a jet 29 of the spray or cleaning medium, but closes outside of this at least one angle range or spray angle for the delivery of the spray or cleaning medium, wherein the nozzle shaft 24 lies with the periphery thereof on a bearing surface 22 of the nozzle member 17, which surface has the at least one first control opening 32, and is secured to the nozzle member 17 through a bearing part 26 overlapping the nozzle shaft 24 at a peripheral area facing away from the bearing surface 22, characterized In that the bearing part 26 is held on the nozzle member 17 through locking.

Another feature or aspect of an embodiment is believed at the time of the filing of this patent application to possibly reside broadly in the spray pipe, wherein the cross-section shape of the at least one first control opening 32 or of the at least one second control opening 33 is selected such that the first control opening 32 or the second control opening 33 has, at a front and/or rear cross-section side, based on an axial direction in which the control openings 32, 33 are moved relative to one another for opening or closing, a shaping that is complementary or substantially complementary to the shape of the second or first control surface 33, 32.

Yet another feature or aspect of an embodiment is believed at the time of the filing of this patent application to possibly reside broadly in a spray pipe for use in a spray station of a cleaning machine, in at least one possible embodiment of the present application, a bottle or container cleaning machine, with a distributor pipe 10 for supplying a liquid spray or cleaning medium, with a plurality of spray nozzles 28 which are provided on the distributor pipe 10 and in each case consist of a nozzle element 17 which is held on the distributor pipe 10 and has at least one first nozzle channel 18 connecting with the interior of the distributor pipe 11 and forming a first control opening 32, as well as of a nozzle shaft 24 which is common to all nozzles 28 or a group of several nozzles 28, which has for each spray nozzle 28 at least one second nozzle channel 25 forming a nozzle opening as well as a second control opening 33 in such a manner that, during the rotation or pivoting of the nozzle shaft 24 about the axis thereof, the respective nozzle 28 opens over at least one angle range of the rotational movement of the nozzle shaft 24, in which (angle range) the at least one first and the at least one second control opening 32, 33 overlap one another, for the delivery of a jet 29 of the spray or cleaning medium, but closes outside of this at least one angle range or spray angle for the delivery of the spray or cleaning medium, wherein the cross-section shape of the at least one first control opening 32 or of the at least one second control opening 33 is selected such that the first control opening 32 or the second control opening 33 has, at a front and/or rear cross-section side based on an axial direction in which the control openings 32, 33 are moved relative to one another for opening or closing, a shaping that is complementary or substantially complementary to the shape of the second or first control surface 33, 32.

Still another feature or aspect of an embodiment is believed at the time of the filing of this patent application to possibly reside broadly in the spray pipe, wherein the nozzle shaft 24 lies with the periphery thereof on a bearing surface 22 of the nozzle member 17, which surface has the at least one first control opening 32, and is secured to the nozzle member 17 through a bearing part 26 overlapping the nozzle shaft 24 at a peripheral area facing away from the bearing surface 22, characterized in that the bearing part 26 is held on the nozzle member 17 through locking.

A further feature or aspect of an embodiment is believed at the time of the filing of this patent application to possibly reside broadly in the spray pipe, wherein the bearing part 26 tightly surrounds the nozzle shaft 24 at the peripheral area having the at least one second nozzle channel 25 and has an opening 27 for the discharge of the nozzle jet 29 during the at least one spray angle.

Another feature or aspect of an embodiment is believed at the time of the filing of this patent application to possibly reside broadly in the spray pipe, wherein in the nozzle shaft 24, there is provided for each spray nozzle 28 at least one second nozzle channel 25 which is open at two peripheral areas of the nozzle shaft 24, which are facing away from one another, and which forms the second control opening 33 at least at one of these peripheral areas.

Yet another feature or aspect of an embodiment is believed at the time of the filing of this patent application to possibly reside broadly in the spray pipe, wherein the at least one second nozzle channel 25 is formed by a bore that is orientated radially or substantially radially to the axis of the nozzle shaft 24.

Still another feature or aspect of an embodiment is believed at the time of the filing of this patent application to possibly reside broadly in the spray pipe, wherein at least two second nozzle channels 25 are provided for each nozzle 28 and specifically such that the spray and control openings formed by these nozzle channels are arranged at the periphery of the nozzle shaft 24 in a manner in which they are mutually offset about the axis of this shaft.

A further feature or aspect of an embodiment is believed at the time of the filing of this patent application to possibly reside broadly in the spray pipe, wherein the second control opening 32 has a circular or substantially circular cross-section, and that the first control opening 32 has, at the front and/or rear cross-section area thereof, in relation to the relative movement of the control openings, a projection 32.1 protruding into the control opening, preferably a projection 32.1 formed in a circular arc shape or substantially circular arc shape.

Another feature or aspect of an embodiment is believed at the time of the filing of this patent application to possibly reside broadly in the spray pipe, wherein the second control opening 32 has a circular or substantially circular cross-section, and that the first control opening 33 has, at the front and/or rear cross-section area thereof, in relation to the relative movement of the control openings, a projection 32.1 protruding into the control opening, preferably a linearly formed projection 32.1.

Yet another feature or aspect of an embodiment is believed at the time of the filing of this patent application to possibly reside broadly in the spray pipe, wherein the first control opening 32 and/or the second control opening 33 is formed as a rectangle.

Still another feature or aspect of an embodiment is believed at the time of the filing of this patent application to possibly reside broadly in the spray pipe, wherein the first control opening 32 and/or the second control opening 33 is formed as a triangle.

A further feature or aspect of an embodiment is believed at the time of the filing of this patent application to possibly reside broadly in the spray pipe, wherein the respective nozzle member 17 is anchored in a torsionally secure manner in an opening 14 of the distributor pipe 11.

Another feature or aspect of an embodiment is believed at the time of the filing of this patent application to possibly reside broadly in the spray pipe, wherein the respective nozzle member 17 is provided, for torsional securing, with at least one section 23 protruding in a wing-like manner, which is accommodated in an appropriate manner in a groove 16 formed at the periphery of the distributor pipe 11.

Yet another feature or aspect of an embodiment is believed at the time of the filing of this patent application to possibly reside broadly in the spray pipe, wherein the nozzle member 17 is a molded part made from plastic.

Still another feature or aspect of an embodiment is believed at the time of the filing of this patent application to possibly reside broadly in the spray pipe, wherein the bearing part 26 securing the nozzle shaft 24 to the respective nozzle member 17 is a molded part made from plastic.

A further feature or aspect of an embodiment is believed at the time of the filing of this patent application to possibly reside broadly in the spray pipe, wherein it has at least one connecting flange 13 with which it can be attached to a supply 3 for supplying the liquid spray or cleaning medium.

Another feature or aspect of an embodiment is believed at the time of the filing of this patent application to possibly reside broadly in the spray pipe, wherein the connecting flange 13 is provided at a connecting piece 12 protruding radially from the distributor pipe 11.

Yet another feature or aspect of an embodiment is believed at the time of the filing of this patent application to possibly reside broadly the spray pipe, wherein the distributor pipe 11 is provided at both ends with, in each case, one connecting flange 13.

Still another feature or aspect of an embodiment is believed at the time of the filing of this patent application to possibly reside broadly in the spray pipe, wherein, at one end of the nozzle shaft 24, a drive or control member 30 is provided for the controlled rotation or pivoting of the nozzle shaft 24.

A further feature or aspect of an embodiment is believed at the time of the filing of this patent application to possibly reside broadly in the spray station with at least one spray pipe 10, which is held at both ends at longitudinal pipes 3 of a support frame 2 and connected with the longitudinal pipes 3, characterized in that the spray pipe 10 is formed in accordance with one of the preceding claims.

Another feature or aspect of an embodiment is believed at the time of the filing of this patent application to possibly reside broadly in the spray station, wherein the longitudinal pipes 3 arranged parallel to one another and at an interval from one another are orientated with the longitudinal extension thereof perpendicular or substantially perpendicular to the longitudinal extension of the at least one spray pipe 10.

Yet another feature or aspect of an embodiment is believed at the time of the filing of this patent application to possibly reside broadly in the spray station, wherein the longitudinal pipes 3 are interconnected via at least one cross-pipe 4 of a pipe-like support frame 2.

Still another feature or aspect of an embodiment is believed at the time of the filing of this patent application to possibly reside broadly in the spray station, wherein, in the case of a plurality of spray pipes 10, the drive and control members 30 of neighboring spray pipes 10 are, in each case, provided on opposite sides of the spray pipes 10 or spray station 1.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the patents, patent applications or patent publications, which were cited in the German Office Action dated May 6, 2008 and International Search Report dated Sep. 3, 2008, and/or cited elsewhere are hereby incorporated by reference as if set forth in their entirety herein as follows: DE 103 15 866 A1, having the following English translation of the German title "Spraying device for purifying machine, has nozzle body with nozzle ducts that are displaceable at 90 angles, the ducts having bores lie in a simultaneous degree circular path" published on Oct. 21, 2004; DE 619 492 C, having the following German title "Spritzduesenbefestigung an Flaschenwaschmaschinen", published on Oct. 2, 1935; GB 789 214, having the following title, "Improvements in or relating to apparatus or machines for cleansing, washing or drying containers", published on Jan. 15, 1958; WO 03/084685 A, having the following English translation of the Italian title "AN APPARATUS FOR WASHING THE INTERIOR OF CONTAINERS MADE OF PLASTIC MATERIAL", published on Oct. 16, 2003; DE 1 0045 932 A1, having the following English translation of the German title "Method for spraying in a bottle cleaning machine involves spraying the bottle bottom by means of a flat spray jet whose cross section is larger than the cross section of the spray jet cleaning the bottle interior", published on Mar. 28, 2002; and DE 641694 C, having the following title "Spritzduesenbefestigung an Flaschenwaschmaschinen", published on Feb. 10, 2007.

Some examples of locking mechanisms or clips, which may possibly be utilized or adapted for use in at least one possible embodiment of the present application, may possibly be found in the following U.S. Pat. No. 5,513,934, having the title "FASTENER FOR TRUCK BED LINER," published on May 7, 1996; No. 7,543,386, having the title "SPRING ASSISTED FOLDING KNIFE," published on Jun. 9, 2009; No. 7,513,075, having the title "LOCKING SWIVEL APPARATUS," published on Apr. 7, 2009; No. 7,314,331, having the title "MULTI-POSITION LOCKING MECHANISMS FOR CLAMPING ASSEMBLIES," published on Jan. 7, 2008; and No. 7,632,035, having the title "FOLDING BABY STROLLER," published on Dec. 15, 2009.

The patents, patent applications, and patent publication listed above in the preceding paragraphs are herein incorporated by reference as if set forth in their entirety. The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2007 030 220.9, filed on Jun. 29, 2007, having inventors Klaus JENDRICHOWSKI, Ulrich WIEDEMANN, and Daniel WALD, and DE-OS 10 2007 030 220.9 and DE-PS 10 2007 030 220.9, and International Application No. PCT/EP2008/004916, filed on Jun. 19, 2008, having WIPO Publication No. WO2009/003586 A1 and inventors Klaus JENDRICHOWSKI, Ulrich WIEDEMANN, and Daniel WALD, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the corresponding foreign equivalent patent applications, that is, PCT/EP2008/004916 and Federal Republic of Germany Patent Application No. 10 2007 030 220.9, is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2008/004916 and Federal Republic of Germany Patent Application No. 10 2007 030 220.9 from which this patent application claims priority which do not have to do with the correction of the translation in this patent application are not to be included in this patent application in the incorporation by reference.

Any statements about admissions of prior art in the original foreign patent applications PCT/EP2008/004916 and Federal Republic of Germany Patent Application No. 10 2007 030 220.9 are not to be included in this patent application in the incorporation by reference, since the laws relating to prior art in non-U.S. Patent Offices and courts may be substantially different from the Patent Laws of the United States.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1 Spray station
2 Support frame
3 Longitudinal pipe
4 Cross-pipe
5 Attachment flange
6 Wall member
7 Ground member
8 Pipe connection
9 Connecting flange
10 Spray pipe unit
11 Distributor pipe
12 Connecting piece
13 Connecting flange
14 Bore
15 Projection
16 Groove
17 Nozzle member
18 Nozzle channel
19 Sleeve body
20,21 Sleeve end
22 Bearing surface
23 Wing-like section
24 Nozzle shaft
25 Nozzle channel
26 Bearing part
27 Spray location or spray nozzle
29 Spray jet
30 Drive star
31 Progression over time of the volume flow
31.1,31.2 Increase and decrease respectively of the volume flow during a spray stage
32,33 Control opening
32.1 Projection on the control opening 32
A Conveying direction for bottles or containers
B Rotating direction of the nozzle shaft 24
X, Y, Z Spatial axes

What is claimed is:

1. A spray cleaning arrangement comprising:

a cleaning medium distributor pipe having openings therein;

a plurality of sprayers, each comprising a channel body and a bearing part;

said channel bodies being connected to said distributor pipe, each having a flow channel connected to a corresponding distributor pipe opening;

a shaft supported on said channel bodies and comprising shaft channels therein;

said shaft being configured to be rotated to connect an opening of each shaft channel to a control opening of a corresponding flow channel to permit spraying of cleaning medium out of said shaft channels, and to be rotated to disconnect said shaft channels from corresponding flow channels to stop spraying of cleaning medium;

each of said channel bodies, together with its corresponding bearing part, encloses and holds a portion of said shaft;

each of said shaft channel openings having a first cross-sectional shape comprising a first perimeter edge portion;

each of said control openings having a second cross-sectional shape comprising a second perimeter edge portion;

at least one of said first and second cross-sectional shapes being non-circular; and said first and second perimeter edge portions being shaped such that, upon said shaft being rotated to move said first perimeter edge portions of said shaft channel openings past said second perimeter edge portions of said control openings, an initial overlap of said shaft channel openings and said control openings has a substantially larger cross-sectional area than if said shaft channel openings and said control openings both had circular, cross-sectional shapes.

2. The spray cleaning arrangement according to claim 1, wherein each of said bearing parts comprises a spray opening to permit the flow of cleaning medium out of said shaft channels.

3. The spray cleaning arrangement according to claim 2, wherein each of said shaft channels is formed by a bore that is oriented radially or substantially radially to the axis of said shaft.

4. The spray cleaning arrangement according to claim 3, wherein at least two of said shaft channels are provided for each sprayer, such that said shaft channel openings are arranged at the periphery of said shaft and are mutually offset about the rotational axis of said shaft.

5. The spray cleaning arrangement according to claim 4, wherein each of said channel bodies is anchored in a torsionally secure manner in an opening in said distributor pipe.

6. The spray cleaning arrangement according to claim 5, wherein each of said channel bodies is provided, for torsional securing, with at least one section protruding in a wing-like manner, which is mounted or connected in a groove formed at or in the periphery of said distributor pipe.

7. The spray cleaning arrangement according to claim 6, wherein each of said channel bodies is a molded part made from plastic, and said bearing part securing said shaft to each of said channel bodies is a molded part made from plastic.

8. The spray cleaning arrangement according to claim 7, wherein said spray cleaning arrangement comprises two connecting flanges, one at each end of said distributor pipe, configured to be attached to a supply for supplying the liquid spray or cleaning medium, which connecting flanges are provided at a connecting piece protruding radially from said distributor pipe.

9. The spray cleaning arrangement according to claim 8, wherein at one end of said shaft, a drive or control member is provided for the controlled rotation or pivoting of said shaft.

10. The spray cleaning arrangement according to claim 9, wherein:

said spray cleaning arrangement further comprises longitudinal pipes of a support frame;

said distributor pipe is held at both ends by and connected with said longitudinal pipes;

said longitudinal pipes are arranged parallel to one another and at an interval from one another, and are oriented with the longitudinal extension thereof perpendicular or substantially perpendicular to the longitudinal extension of said spray pipe;

said longitudinal pipes are interconnected via at least one cross-pipe of said support frame; and said spray cleaning arrangement further comprises at least one other distributor pipe, plurality of sprayers, and shaft, wherein said drive or control members of adjacent shafts are disposed at opposite ends of said spray cleaning arrangement.

11. The spray cleaning arrangement according to claim 1, wherein:

said first cross-sectional shape of each of said shaft channel openings is circular or substantially circular; and said second cross-sectional shape of each of said control openings has a circular or substantially circular cross-section with first and second concave, inward, projections therein disposed on opposite sides such that:

upon said shaft channel opening being moved toward its corresponding control opening by rotation of said shaft, the edge of said first concave projection substantially matches and overlaps the perimeter edge of a leading portion of said shaft channel opening; and upon said shaft channel opening being moved away from its corresponding control opening by rotation of said shaft, the edge of said second concave projection substantially matches and overlaps the perimeter edge of a trailing portion of said shaft channel opening.

12. The spray cleaning arrangement according to claim 1, wherein:

said first cross-sectional shape of each of said shaft channel openings is circular or substantially circular; and said second cross-sectional shape of each of said control openings is circular or substantially circular but with first and second linear, inward, projections therein disposed on opposite sides.

13. The spray cleaning arrangement according to claim 1, wherein:

said first cross-sectional shape of each of said shaft channel openings is rectangular or substantially rectangular; and said second cross-sectional shape of each of said control openings is rectangular or substantially rectangular.

14. The spray cleaning arrangement according to claim 1, wherein:

said first cross-sectional shape of each of said shaft channel openings is triangular or substantially triangular; and said second cross-sectional shape of each of said control openings is triangular or substantially triangular.

* * * * *